US005231899A

United States Patent [19]

Lee

[11] Patent Number: 5,231,899

[45] Date of Patent: Aug. 3, 1993

[54] DRILLING RIG BREAKOUT WRENCH SYSTEM

[75] Inventor: Douglas W. Lee, Wichita, Kans.

[73] Assignee: Straightline Manufacturing, Inc., Newton, Kans.

[21] Appl. No.: 995,955

[22] Filed: Dec. 23, 1992

Related U.S. Application Data

[63] Continuation of Ser. No. 872,907, Apr. 23, 1992, abandoned.

[51] Int. Cl.[5] ..... B25B 13/50

[52] U.S. Cl. ..... 81/57.16; 81/57.18; 81/57.35

[58] Field of Search ..... 81/57.14, 57.15, 57.16, 81/57.18, 57.3, 57.33, 57.34, 57.35, 59.1

[56] References Cited

U.S. PATENT DOCUMENTS

| | | | |
|---|---|---|---|
| 2,737,839 | 3/1956 | Paget | 81/57.35 |
| 3,239,016 | 3/1966 | Alexander | 29/426.5 |
| 3,662,862 | 5/1972 | Kinzbach | 81/59.1 X |
| 3,799,009 | 3/1974 | Guier | 81/57.16 |
| 4,023,449 | 5/1977 | Boyadjieff | 81/57.16 |
| 4,372,026 | 2/1983 | Mosing | 81/57.18 X |
| 4,437,218 | 3/1984 | Pridy | 81/57.35 X |

OTHER PUBLICATIONS

Failing Equipment Supply Catalog 7th Edition, Section 4, p. 9; Section 5, p. 10 and Section 15, pp. 15, 16 and 17.

*Primary Examiner*—D. S. Meislin
*Attorney, Agent, or Firm*—Edward L. Brown, Jr.

[57] ABSTRACT

A pair of bi-directional breakout wrenches on a drilling rig, each wrench including a body member having an inside cam surface with a plurality of locking cogs positioned around the cam surface, each cog being rotatably journaled on a shaft with a loose-fit allowing the cogs limited lateral movement and a pair or side plates positioned on the sides of the body member supporting the cog shafts, the side plates including a handle for rotation of the side plates relative to the wrench body causing the locking cogs to engage the cam surface and move inwardly gripping the drill pipe section. One of said wrenches being attached to a linear actuator providing rotative torque to the wrench body for breaking open a threaded drill string joint while the other wrench retains the string from movement.

10 Claims, 3 Drawing Sheets

DRILLING RIG BREAKOUT WRENCH SYSTEM

This is a continuation of application Ser. No. 07/872,907, filed on Apr. 23, 1992, which was abandoned upon the filing hereof.

BACKGROUND OF THE INVENTION

The invention relates to wrenches for breaking drill pipe joints and more specifically to a pair of wrenches rotatably mounted on the drilling frame, one being hydraulically actuated for making and breaking the threaded joints when adding to or removing drill pipe sections which make up a string of drill pipe in a lightweight horizontal boring rig.

Conventional drill pipe sections utilized on all types and size of drilling rigs consists of an externally tapered threaded pin on one end of the section with a mating internally threaded box on the opposite end for receipt of the pin of the next section. These tapered threaded couplings, generally called tool joints, require some form of wrench means to tighten up the joints as well as break them loose. In rotary table conventional oil field drilling rigs, tapered slips are utilized to grip and hold the drill pipe with the weight of the drill pipe holding the slips engaged. In a George E. Failing Company catalog, section 4, page 9, a non tapered roller slip assembly is shown, which is utilized in a breakout table. These roller slips are actuated into engagement by rotating the breakout table with its square shaped camming surface.

Another commonly used locking device are oil field tongs which grab in only one direction and must be flipped over to work in the opposite direction.

Another wrench means is the fixed jaw wrench as illustrated in Alexander U.S. Pat. No. 3,239,016. While fixed jaw wrenches do work in both directions, their primary disadvantage is that they require that a pair of flats must be machined into the outer surface of both ends of all sections of the drill pipe which substantially increases the drill pipe cost.

Another method of breaking joints is the utilization of conventional pipe wrenches which are limited in the torque they can apply with also the danger of slipping under torque.

SUMMARY OF THE INVENTION

The wrenches of the present invention work bi-directionally so it is not necessary to turn them over during use and they are very easy to actuate with only a small movement of the control handle being required to engage the drill pipe. Both wrenches are rotatably mounted to the frame of the drilling rig so that they can be quickly swung out of position when they are not needed. One of the wrenches is rotatably attached to a hydraulic cylinder for the application of high torque levels required to break open certain joints. When screwing sections of drill pipe together, only a single wrench is required to hold the section already in the ground while the rotary motor on the rig provides the necessary torque to make the joint. The wrenches of the present invention are both attached to the drill frame which provides an obvious safety factor over conventional pipe wrenches which are manually torqued with the always present danger of slipping.

It is therefore the principal object of the present invention to provide a drill pipe wrench system which works in both directions and requires low operator exertion to break already made-up joints.

Another object of the present invention is to provide a wrench system which is safe in that both wrenches are attached to the drill frame and the amount of manually applied torque is nominal since the breakout torque is provided by a hydraulic cylinder.

A further object of the present invention is a wrenching system which reduces the time necessary to do a bore by 50% (percent) since the wrenches are left in an operating position during the drilling of the bore and the removal of the drill string from the bore.

DESCRIPTION OF THE DRAWINGS

FIG. 8 is a partial sectional view similar to FIGS. 5 and 6, illustrating a modified form of the present invention.

Figure 1:
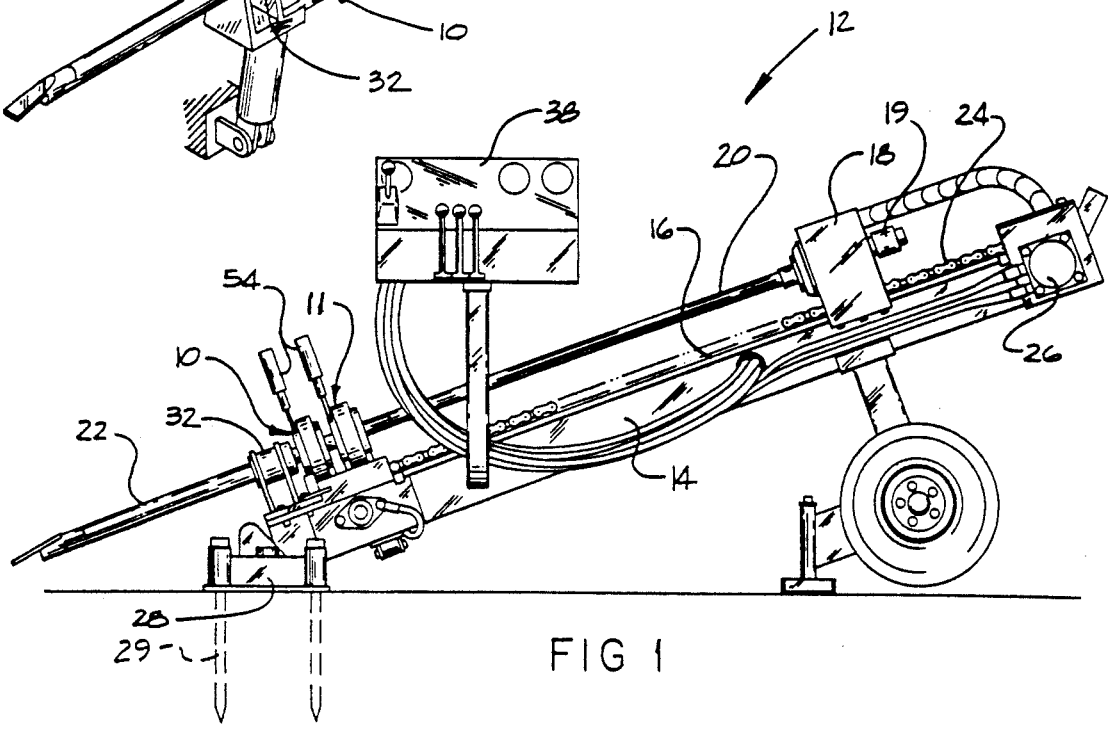
FIG. 1 is a side elevational view of the complete drilling rig with the drill bit and a section of drill pipe positioned in the rig.

Referring now to the drawing and specifically to FIG. 1, the drilling rig is generally identified by reference numeral 12. Directional horizontal boring is a recent technology developed in the last decade which provides small diameter horizontal boring machines wherein the path and direction of a bore can be guided during boring with the use of directional boring heads and radio transmitters for tracking the actual location of the drilling head. These types of drilling rigs or boring machines are relatively small and light in comparison with the large vertical rigs used in the oil field and their field of use is primarily suited for the installation of small diameter underground utility service which was previously accomplished by trench digging equipment. These types of directional boring rigs provide the obvious advantage of time and an undisturbed surface which is very cost effective when compared with open cut excavations.

The drilling rig 12 includes a drill rack or frame 14 which supports a movable carriage 18. The carriage 18 is moved up and down the rack by chain 24 driven by a sprocket and hydraulic motor 26. Since the drilling rig 12 is not part of the invention, the details of the rig structure are not shown in detail but rather generally described since they are well known in the prior art. Carriage 18 includes a rotary motor 19 which rotates the drill pipe during the drilling operation and is hydraulically driven through a common hydraulic power source not shown in the drawings. Located at the lower left end of the drilling rig is an anchor plate 28 which is attached to the ground by stakes 29 or any other anchoring means, such as augers. Positioned at the left end of the track slide 16 is a guide sleeve 32 which guides the drill bit 22 and its connecting drill pipe 20 into the ground as the carriage 18 moves down slide 16. The drilling action is achieved by a combination of water jets positioned in the drill bit face, rotation of the drill bit and a linear pushing force, commonly referred to as thrust boring, by carriage 18. Various configurations of heads are utilized, depending on the soil encountered. In harder soils, bits utilize mechanical cutting ability from the rotating head while in softer soils, high pressure water jets in the bit face provided fluid cutting. The directional control of the head is achieved by various means such as a slanted face or slanted jets. The general size and length of the bores are generally less than 5 inches in diameter on the pilot bore with a maximum range or 500 feet. Referring back to FIG. 1, control panel 38 provides the necessary hydraulic valves and controls to provide the rotation, thrust on the drill string, and the fluid cutting pressure within the drill string. Since the steering methods of these rigs is well known in the prior art and is not a part of the present invention, they will not be described herein.

Figure 6:
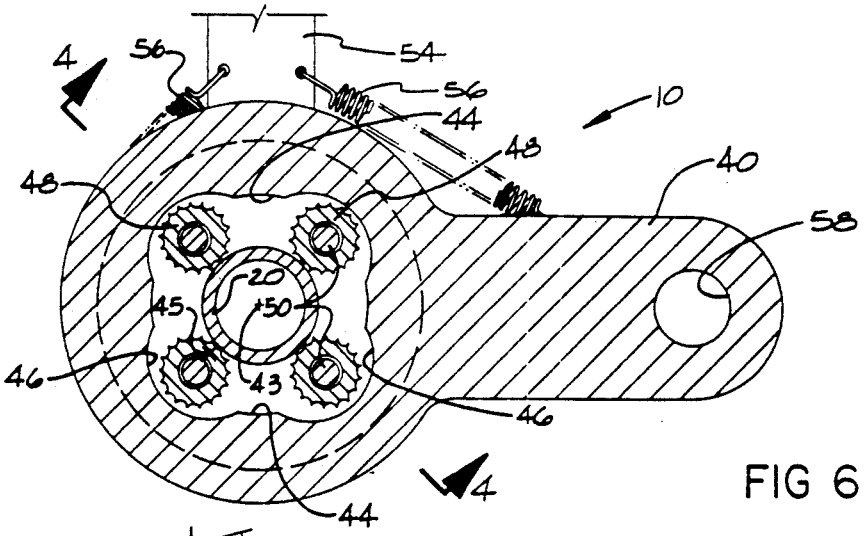
FIG. 6 is a similar view to FIG. 5 with the locking cogs in their release position.
Figure 5:
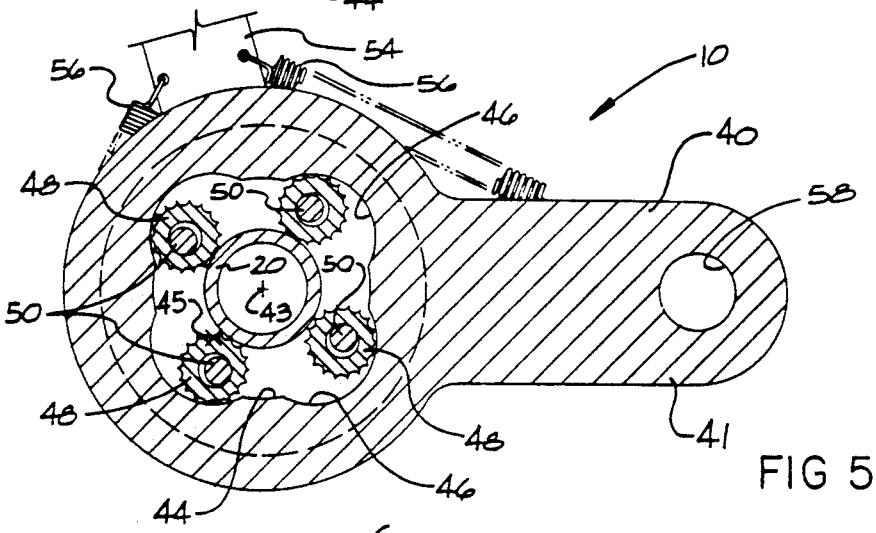
FIG. 5 is a view taken along line 5—5 of FIG. 4 with the cogs in their locking position.
Figure 4:
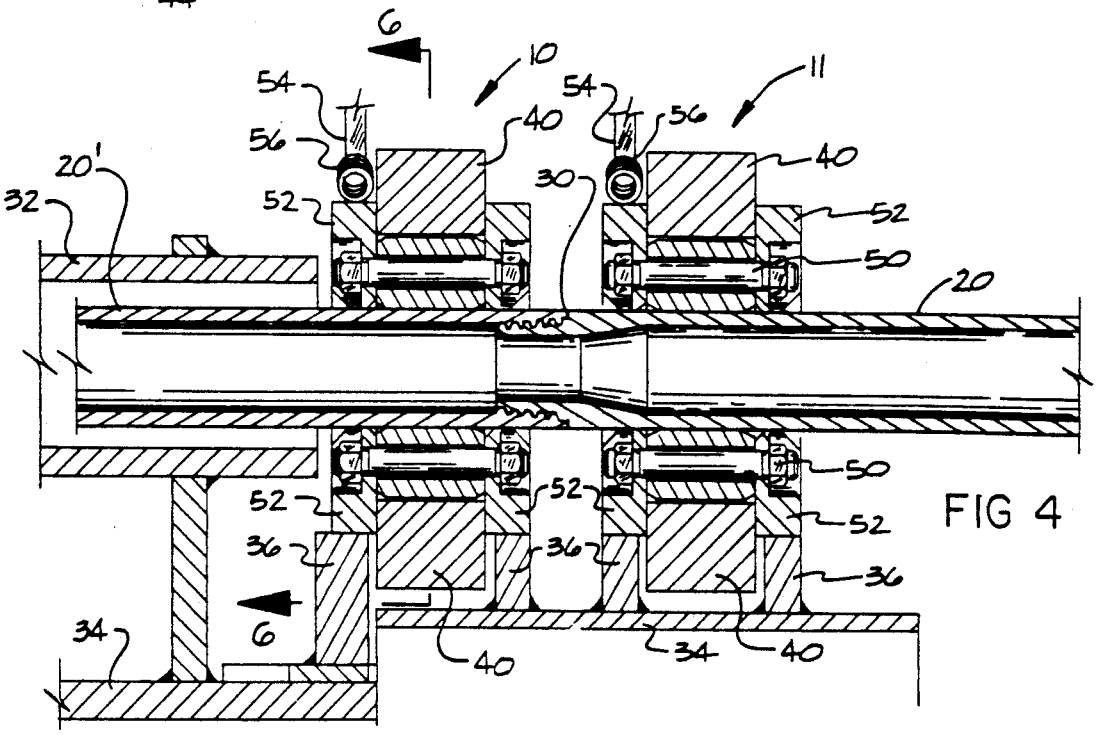
FIG. 4 is a longitudinal sectional view of the two wrenches and drill pipe joint to an enlarged scale.
Figure 7:
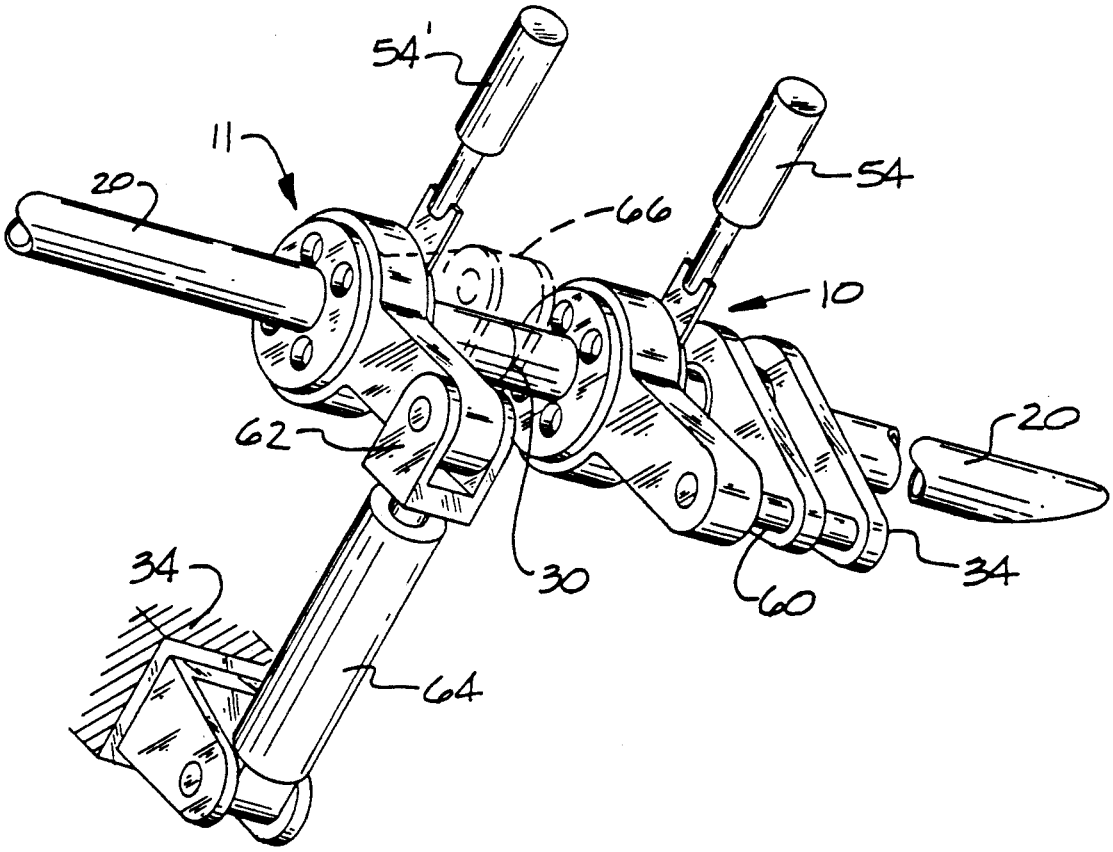
FIG. 7 is perspective view from the opposite side of FIG. 2 illustrating the various positions of the actuating cylinder.

The two wrenches 10 and 11 of the present invention are basically identical as can be readily seen in FIGS. 4, 5, and 6, with the only difference being that wrench 11 can not only hold but apply substantial torque through actuation of hydraulic cylinder 64, as seen in FIG. 7.

Figure 2:
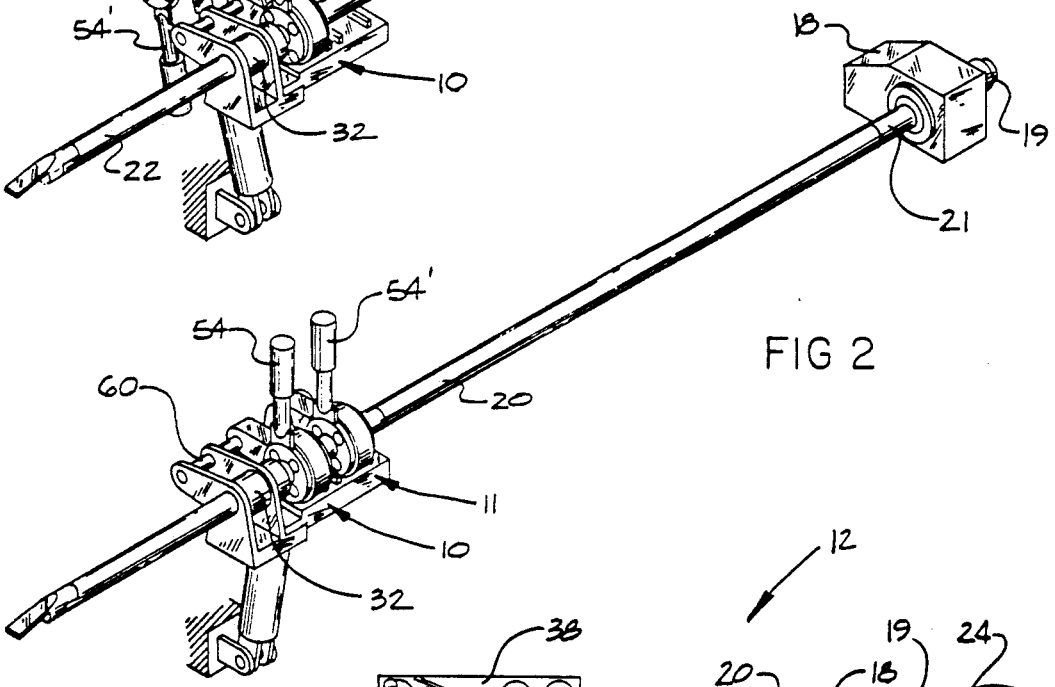
FIG. 2 is a partial perspective view of the two wrenches and the rotary motor when utilized for withdrawal of the drill pipe sections from the bore.

In viewing FIGS. 4, 5, and 6, wrench 10 includes a body 40 with an arm extension 41 having a bearing 58 at its outer end for rotation on shaft 60 which is in turn mounted on the drilling frame through guidesleeve 32 (see FIG. 2). The body 40 of the wrench has an inside camming surface made up of a circular bore 44 having a center point 43 and a series of four extended arcuate surfaces 46. Each of the extended arcuate surfaces has a center point 45 with a radius less than circular bore 44. Positioned in the extended arcuate surfaces 46 are four locking cogs 48, each of which is loosely mounted on a fixed shaft 50. Shafts 50 are in turn anchored to side plates 52, as best seen in FIG. 4, limiting the lateral movement of the locking cogs 48 rotatably mounted on shafts 50. The differences between the inside diameter of cogs 48 and the outside diameter of their respective shafts 50 is sufficient to allow the cogs 48 to move laterally from a non-gripping position on the drill pipe 20, as seen in FIG. 6 to the gripping position of the drill pipe as shown in FIG. 5. Attached to side plates 52 is a radially extending handle 54 which is normally spring centered by springs 56 to its non-gripping position as shown in FIG. 6. The manual rotation of handle 54 rotates side plates 52 which in turn move locking cogs 48 laterally causing the cogs to ride up the arcuate surface 46 and engage drill pipe 20 from all four sides. Once the cogs 48 have engaged drill pipe 20, any further attempt to rotate the drill pipe in a counterclockwise direction, as viewed in FIG. 5, merely tightens the locking cogs on the drill pipe 20. To lock the drill pipe from rotation in the opposite or clockwise direction, handle 54, as seen in FIG. 6, is pulled in a clockwise direction, thereby gripping arcuate surfaces 46 on the opposite side from that shown in FIG. 5.

Wrenches 10 and 11 are not only pivotally mounted to shafts on the drilling rig but are also limited from longitudinal movement along with the drill pipe 20 by lugs 36 as seen in FIG. 4. In both wrenches 10 and 11 the lower portion of the wrench body 40 is positioned between a pair of lugs 36, thereby preventing any movement with the drill pipe 20. If, for example, the locking cogs 48 of one of the wrenches accidentally gripped the drill pipe 20 while it was being extended or retracted, the lugs 36 would prevent damaging side loadings on either wrenches 10 or 11.

OPERATION

Figure 3:
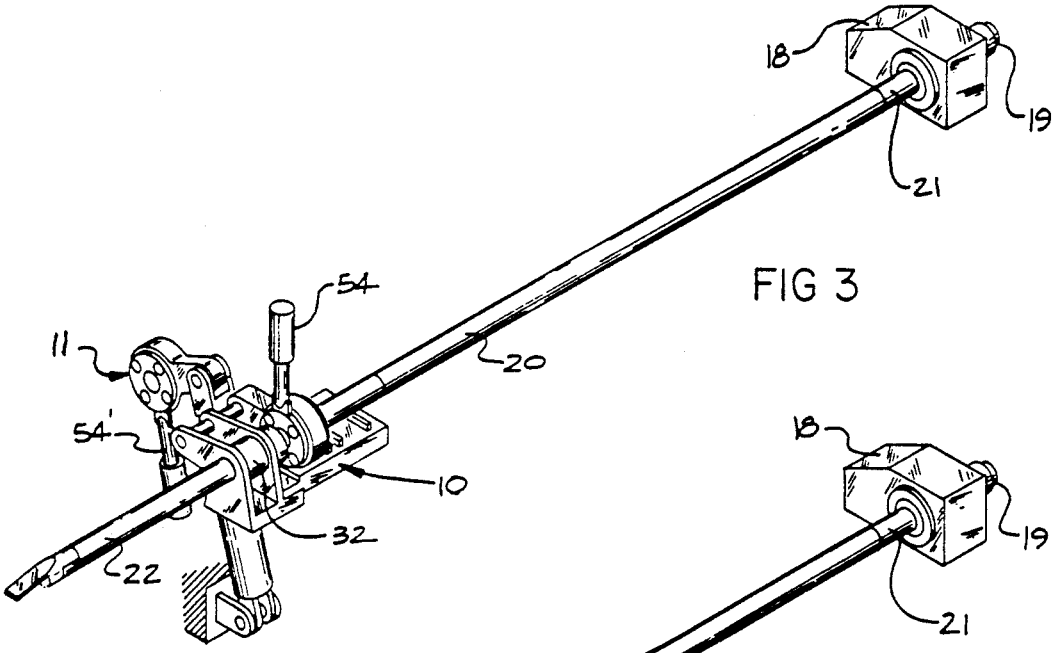
FIG. 3 is a similar perspective view to FIG. 2 with one of the wrenches swung out of position when utilized for introducing sections of drill pipe into the bore.

In the drilling operation, which is basically adding sections of drill pipe 20 to the drill string as it moves into the ground, only a single wrench 10 is utilized as shown in FIG. 3. Wrench 11 is swung out or position, as illustrated in FIG. 3.

The initial drill pipe section 20 is manually threaded into a drive collar 21 on carriage 18. The drill bit 22 is inserted through wrench 10 and the tapered male threads on the left end of drill pipe- 20 are engaged and manually started. Handle 54 is manually moved a short distance in a counterclockwise direction, as viewed in FIG. 3, until locking cogs 48 ride up arcuate surfaces 46 and grip the drill bit 22. With handle 54 manually held in this position, the rotary motor 19 is actuated and begins to slowly rotate, tightening up the thread joints on both ends of drill pipe 20. Since wrench 10 is holding bit 22 against rotation, the action of rotary motor 19 will snug up and sufficiently tighten both threaded joints previously mentioned. The drill rig 12 is now ready to begin its bore, and carriage 18 begins movement along slide 16 while rotary motor 19 turns the drill string. When carriage 18 reaches the end of its stroke, approximate wrenches 10 and 11, it is necessary to add an additional section 20 of drill pipe. Handle 54 on wrench 10 is again lightly pulled, however in a clockwise direction this time since it is desired to break the threaded joint at the drive collar 21 with reverse rotational movement of motor 19. While handle 54 is holding the drill string in the ground, clockwise torque is applied to drive collar 21 by rotary motor 19, thereby breaking the joint. Once the joint is broken, carriage 18 is retracted up its track to the far right position, as illustrated in FIGS. 2 and 3. The next section of drill pipe 20 is then manually inserted in the threaded joint on the open end of the down hole drill string, with the drive collar 21 manually threaded on the opposite end of newly added drill pipe 20. Wrench handle 54 is then moved to the left, as seen in FIG. 3, causing the cogs 48 to grip the down hole drill string while the torque from rotary motor 19 snugs up the joint 30 between the sections and the drive collar 21.

After the bore has been completed and it is desirous to pull the drill string back out of the bore or back-ream the bore to a larger diameter, the second wrench 11 is rotated into its operative position as seen in FIG. 2. To achieve this, the longitudinal position of the last joint 30 must be positioned between wrenches 10 and 11, as seen in FIG. 4. Handle 54 on wrench 10 is moved to the right, as seen in FIG. 2, locking wrench 10, while wrench handle 54' is moved to the right engaging wrench 11. Hydraulic cylinder 64 is stroked out, rotating wrench 11 clockwise, thus breaking joint 30 between the two wrenches 10 and 11. The wrenches are released and the rotary motor 19 further unthreads joint 30 until the up hole section 20 is almost out of the down hole drill pipe section. Then handle 54' of wrench 11 is moved to the right, locking up hole section 20 in order to unscrew its upper end from drive collar 21 through the torque applied by rotary motor 19. Once this joint is broken loose, the pipe section is removed and the carriage is extended down the track with collar 21 engaging the threaded end of the down hole drill pipe section 20. Once engaged, the carriage retracts up slide 16 pulling the next section 20 from the hole. This section is broken loose with the use of both wrenches 10 and 11 through the actuation of cylinder 64, as just previously described. With the use of both wrenches and the actuation of cylinder 64 on wrench 11, high levels of torque, in excess of those available from rotary motor 19, can be applied to drill pipe joints. Through the process of long drilling bores, joints become quite tight and require greater amounts of torque than normally provided by motor 19.

While the design of wrench 10 illustrates four locking cogs 48, the wrench could also be constructed with three cogs or more than four. With the steel on the cam surface of the wrench 10 being harder than the steel in the cogs, the cogs will wear and can be readily replaced at a minimum expense.

In place of handle 54 can be other types of actuation which can be remotely controlled. As for example, attached to handle 54, could be a hydraulic cylinder, 70, as shown in FIG. 8 an electrically powered solenoid or a manual cable and wire actuator. Either or both wrenches 10 and 11 can be remotely controlled.

While the invention has been described with a certain degree or particularity, it is manifest that many changes may be made in the details of construction and the arrangement of the components of the wrenches without departing from the spirit and scope of this disclosure. It is understood that the invention is not limited to the embodiment set forth herein, but is to be limited only by the scope of the attached claims including the full range of equivalents to which each element is entitled.

What is claimed is:

1. A breakout wrench utilized on a drilling rig to break open threaded joints of drill pipe sections in either direction comprising:

a body member including an extension arm means which is pivotally attached to the drilling rig allowing the wrench to be swung out of its working position on the drilling rig;

an inside cam surface on the body;

a plurality of locking cogs positioned inside the cam surface, each cog being rotatably journaled on a shaft with a loose fit allowing the cogs limited lateral movement;

extended arcuate surface means on the cam surface partially surrounding each locking cog, allowing outward lateral movement of the cogs so a drill pipe section can freely pass between the cogs, and;

side plate means on the side of the body member supporting the cog shafts, the side plate means including a handle for rotation of the side plate means relative to the body causing the locking cogs to engage the extended arcuate surface of the cam surface and move inwardly into gripping engagement with the drill pipe section.

2. A breakout wrench, as set forth in claim 1, with four locking cogs spaced 90 degrees apart with corresponding extended arcuate surfaces.

3. A breakout wrench, as set forth in claim 1, including a second wrench pivotally attached to the drilling rig through an extension arm, each wrench in its working position is adjacent to and concentrically positioned with respect to the other wrench.

4. A breakout wrench, as set forth in claim 1, wherein the cam surface extends 360 degrees, having a concentric center point and an average radius, the extended arcuate surfaces having radii less than said average radius.

5. A breakout wrench, as set forth in claim 1, the extension of the body member being attached to a linear actuator means in turn is pivotally attached to the drill rig, the actuator means provides rotative torque to the wrench body.

6. A breakout wrench, as set forth in claim 1, including a biasing means to the side plate means urging the side plate means and its supported locking cogs into an open non-gripping position.

7. A breakout wrench as set forth in claim 1, with three locking cogs spaced 120 degrees apart with corresponding extended arcuate surfaces.

8. A breakout wrench as set forth in claim 1, including remotely controlled actuating means attached to the side plate means for rotating the plate means relative to the body member and cause the locking cogs to grip or release the drill pipe section.

9. A drilling rig breakout wrench system including:

a drilling rack;

a string of drill pipe sections;

a carriage movable on the rack which rotates and advances the string of drill pipe;

a pair of breakout wrenches removably attached in side-by-side relation to the drill rack and positioned for passage therethrough of the string of drill pipe during drilling and removal, each wrench having:

a body member including an extension arm pivotally attached to the drill rack allowing the wrench to be swung out of its working position on the drill rack;

an inside cam surface on the body;

a plurality of locking cogs positioned inside the cam surface, each cog being rotatably journaled on a shaft with a loose fit allowing the cogs limited lateral movement;

extended arcuate surface means on the cam surface partially surrounding each locking cog, allowing outward lateral movement of the cogs so a drill pipe section can freely pass between the cogs, and side plate means on the side or the body member supporting the cog shafts, the side plate means including a handle for rotation of the side plate means relative to the body causing the locking cogs to engage the extended arcuate surface of the cam and move inward into gripping engagement with the drill pipe section.

10. A breakout wrench as set forth in claim 1, including a second wrench pivotally attached to the outlying rig through a linear actuator means which provides rotative torque to the second wrench, each wrench in its working position is adjacent to and concentrically positioned with respect to the other wrench.

* * * * *